US009135836B2

(12) United States Patent
Benumof et al.

(10) Patent No.: US 9,135,836 B2
(45) Date of Patent: Sep. 15, 2015

(54) SIGN GUARD

(71) Applicant: Public Safety Industries, LLC, San Clemente, CA (US)

(72) Inventors: Benjamin Todd Benumof, San Clemente, CA (US); Richard Edwin Wilson, San Clemente, CA (US)

(73) Assignee: Public Safety Industries, LLC

( * ) Notice: Subject to any disclaimer, the term of this patent is extended or adjusted under 35 U.S.C. 154(b) by 0 days.

(21) Appl. No.: 13/943,659

(22) Filed: Jul. 16, 2013

(65) Prior Publication Data

US 2014/0041269 A1 Feb. 13, 2014

Related U.S. Application Data

(63) Continuation-in-part of application No. 13/707,456, filed on Dec. 6, 2012, now abandoned.

(60) Provisional application No. 61/682,638, filed on Aug. 13, 2012.

(51) Int. Cl.
*G09F 15/00* (2006.01)
*G09F 7/18* (2006.01)

(52) U.S. Cl.
CPC ..... *G09F 7/18* (2013.01); *G09F 2007/1804* (2013.01); *G09F 2007/1813* (2013.01); *G09F 2007/1826* (2013.01)

(58) Field of Classification Search
CPC G09F 7/18; G09F 2007/1804; G09F 15/0037
USPC ..... 40/607.01, 607.11, 612, 661.03, 753; 248/218.4, 219.1, 219.2, 219.3, 219.4
See application file for complete search history.

(56) References Cited

U.S. PATENT DOCUMENTS

| | | | | |
|---|---|---|---|---|
| 1,529,752 | A | | 3/1925 | Sprung et al. |
| 2,581,762 | A | | 1/1952 | Hesse |
| 2,622,357 | A | | 12/1952 | Sprung |
| 3,294,353 | A | | 12/1966 | Rowe |
| 4,776,117 | A | * | 10/1988 | Astolfi ..... 40/761 |
| 4,777,750 | A | * | 10/1988 | Garfinkle ..... 40/607.04 |
| 5,675,923 | A | | 10/1997 | Sarkisian et al. |
| 5,702,081 | A | * | 12/1997 | Gallemore, II ..... 248/218.4 |
| 5,974,712 | A | | 11/1999 | Kallionpaa |
| 6,378,831 | B1 | | 4/2002 | Copeland, Jr. |
| 7,386,928 | B1 | | 6/2008 | Crorey |
| 7,698,843 | B2 | | 4/2010 | Hillstrom et al. |
| 7,877,912 | B1 | | 2/2011 | Ley-Owens |
| 2003/0110673 | A1 | | 6/2003 | Tomboris |

* cited by examiner

*Primary Examiner* — Joanne Silbermann
(74) *Attorney, Agent, or Firm* — Stetina Brunda Garred & Brucker

(57) ABSTRACT

A sign guard for protecting pedestrians and pets from sharp edges of a sign is disclosed. The sign guard may have a recess within which the sign is received. The recess may be sufficiently deep to cover the sharp edges of the sign to mitigate injury to pedestrians and pets. The sign guard may have a through hole for lightening the weight of the sign guard as well as relieving stress to prevent warpage during certain manufacturing techniques. Additionally, the sign guard may have two (2) mounting pads which protrude inwardly into the through hole for mounting the sign and sign guard to a post. Holes may be drilled or preformed in the mounting pads that line up to the mounting holes of the sign. Alternatively, the sign may be mounted to the sign guard and post by way of a retaining clip.

10 Claims, 8 Drawing Sheets

SIGN GUARD

CROSS-REFERENCE TO RELATED APPLICATIONS

This application is a continuation in part application of U.S. patent application Ser. No. 13/707,456, filed on Dec. 6, 2012, which claims the benefits of U.S. Prov. Pat. App. Ser. No. 61/682,638, filed on Aug. 13, 2012, the entire contents of which are expressly incorporated herein by reference.

STATEMENT RE: FEDERALLY SPONSORED RESEARCH/DEVELOPMENT

Not Applicable

BACKGROUND

The various embodiments disclosed herein relate to a guard for protecting pedestrians and pets from sharp edges of a publicly accessible sign.

Signs are used in publicly accessible areas to direct traffic, provide warning, provide instructions and other uses. In order for these signs to be effective, the signs should be visible and are typically vertically positioned at seven feet but are often vertically positioned below and above this height. During normal pedestrian traffic, pedestrians and pets may come into contact with the sign. By way of example and not limitation, signs are placed in parking lots, biking trails, hiking trails, sidewalks, common areas for meetings and other locations. Pedestrians and pets traverse the area and may come into close proximity with the sign. Due to manufacturing techniques and sign designs, signs that have sharp edges thereby pose a public safety hazard.

Accordingly, there is a need in the art for a device and method to protect pedestrians and pets from injury from publicly accessible signs.

BRIEF SUMMARY

In an aspect, a guard for protecting pedestrians from a sign having a sharp outer perimeter is disclosed. The guard may comprise a body, a post, and at least one fastener. The body may have a flat sheet configuration. An outer perimeter of the body may be larger than the outer perimeter of the sign. The body may have a recess disposed at a central portion of the body. The recess may define a lower surface and a side surface. The side surface may have the same configuration as the outer perimeter of the sign and may be sized to be slightly larger than the outer perimeter of the sign. The lower surface may contact a back surface of the sign to regulate an insertion distance of the sign into the recess. The lower surface also has a through hole for reducing weight and stress relieving. The post is used to mount the sign and the body at a height visible to pedestrians. The at least one fastener may be secured to the sign and the lower surface of the recess or mounting pad.

The sign may be received into the recess of the body with the sharp outer perimeter of the sign covered by the side surface of the recess. A back surface of the sign may contact the lower surface of the recess. The fastener may be used to mount the sign and the body to the post. The fastener may penetrate the lower surface of the recess.

A depth of the side surface may be equal to or greater than a thickness of the sign.

The side surface of the recess may have a circular configuration, square configuration, diamond configuration or hexagonal configuration.

The lower surface of the recess may form at least one mounting pad protruding inwardly into the through hole for mounting the body of the sign guard to the sign.

In another aspect, a method of manufacturing a guard for a sign is disclosed. The method may comprise the steps of providing a multi layer polyethylene sheet; milling a recess in the polyethylene sheet defining a side surface and a lower surface; and milling a through hole in the lower surface for relieving stress between layers of the multi-layer polyethylene sheet to mitigate warping.

The milling the recess step may include the step of milling the recess to a depth equal to or greater than a thickness of the sign.

The method may further comprise the step of milling two mounting pads extending inwardly into the through hole for mounting the sign and the guard to a post.

In another aspect, a method of manufacturing a guard for a sign is disclosed. The method may comprise the steps of providing a mold having a cavity to form a body having a flat sheet configuration, an outer perimeter of the body being larger than the outer perimeter of the sign, the body having a recess disposed at a central portion of the body, the recess defined by a lower surface and a side surface, the side surface having the same configuration as the outer perimeter of the sign and sized to be slightly larger than the outer perimeter of the sign, the lower surface contacting a back surface of the sign, the lower surface further having a through hole; mounting the mold to an injection molding machine; and injecting injectable material into the injection molding machine to form the guard.

The injectable material may be plastic, polymer, thermoplastic, thermoset or elastomer.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
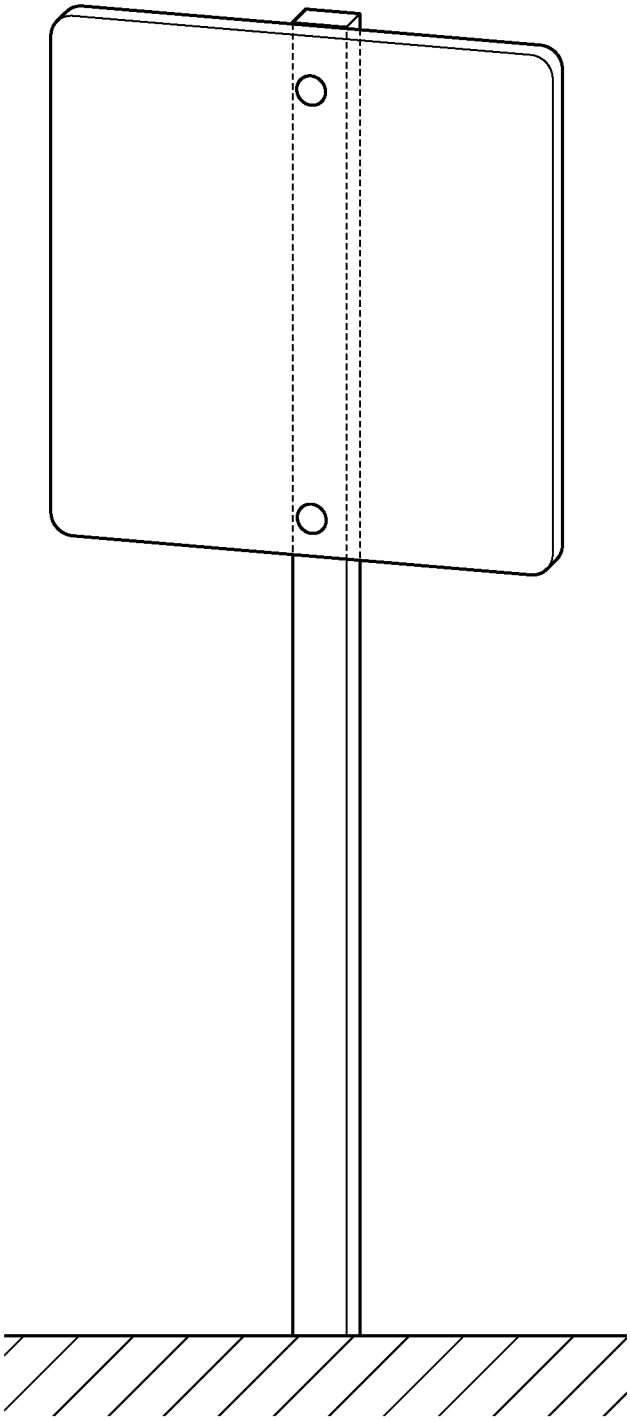
FIG. 1 PRIOR ART
FIG. 1 is an illustration of a prior art sign vertically positioned with a post.

Referring now to the drawings, a sign guard 10 for protecting pedestrians and pets from sharp edges 12 of the sign 14 is shown. The sign guard 10 may have an outer perimeter 16 which has a footprint larger than a footprint of an outer perimeter 18 of the sign 14. The sign guard 10 may have a recess 20 for receiving the sign 14. The recess 20 is smaller than the outer perimeter 16 of the sign guard 10. Moreover, the recess may have a side surface 22 having a configuration that matches the configuration of the outer perimeter 18 of the sign 14. A depth 24 of the recess 20 may be equal to or greater than a thickness 26 of the sign 14. The recess 20 may also define a lower surface 28 that contacts a backside of the sign 14. In this manner, the sign 14 is received into the recess 20. Also, the sharp edges 12 are covered by the border 30. The outer perimeter 16 of the sign guard 10 may have rounded edges or other non-abrasive configuration so that pedestrians and pets will not be cut by the sign guard 10 in the event that the pedestrian or pet inadvertently bumps into the sign guard 10. Importantly, the border 30 of the sign guard 10 prevents the pedestrian or pet from being cut from the sharp edges 12 of the sign 14.

Figure 2:
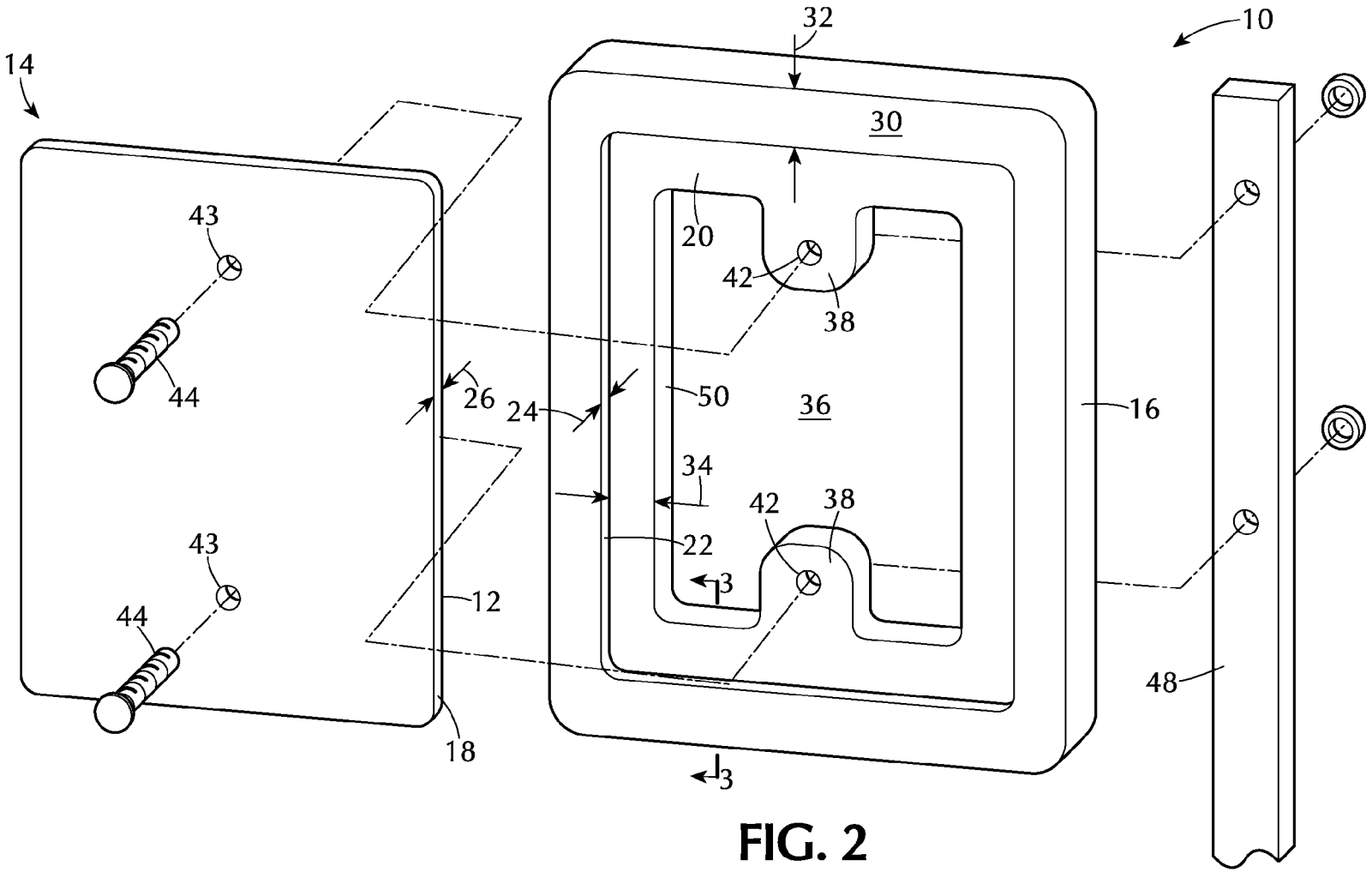
FIG. 2 is an exploded perspective view of a sign guard for protecting pedestrians from sharp edges of the sign.

More particularly, referring now to FIG. 2, the sign guard 10 may have a border 30 that protects pedestrians and pets from the sharp edges 12 of the sign 14 by covering the sharp edges 12 and preventing pedestrians and pets from contacting the sharp edges 12 of the sign. The border 30 may have a thickness 32 that mitigate contact between the sharp edges 12 of the sign 14 and the pedestrians or pets. The thickness 32 may be 1/8 of an inch thick to 5 inches or more. The thickness 32 may be uniform about the perimeter to preserve the perimeter shape of the sign 14. In the example shown in FIG. 2, the sign 14 has a rectangular shape. Moreover, the recess 20 has a rectangular shape and the outer perimeter 16 of the sign guard 10 also has a rectangular shape. In this instance, the rectangular shape of the sign 14 is preserved. For stop signs which have a hexagonal configuration, the outer perimeter 16 of the sign guard 10 may also have a hexagonal configuration to preserve the intended meaning of the hexagonally shaped stop sign 14. Although the thickness 32 of the border 30 of the sign guard 10 is shown and described as being consistent around the entire perimeter of the sign guard 10, it is also contemplated that the outer perimeter 16 of the sign guard 10 may have other configurations such as wavy, rectangular, etc. Moreover, the outer perimeter 16 of the sign guard 10 may have a different configuration compared to the outer perimeter 18 of the sign 14. By way of example and not limitation, the outer perimeter 18 of the sign 14 may be rectangular, whereas, the outer perimeter 16 of the sign guard 10 may be circular.

The border 30 is defined by the outer perimeter 16 of the sign guard 10 and a side surface 22 defined by the recess 20 which receives the sign 14. The recess 20 may be formed to have a depth 24 equal to or greater than a thickness 26 of the sign 14 to ensure that the border 30 sufficiently covers the sharp edges 12 of the sign 14. However, it is also contemplated that the depth 24 of the recess 20 may be smaller than the thickness 26 of the sign 14. In this instance, the sign guard 10 still protects pedestrians and pets from lacerations from the sharp edges 12 of the sign 14 since the border 30 prevents the pedestrian and pet from contacting the sharp edges 12 of the sign 14. The sharp edges 12 are juxtaposed to the side surface 22 of the sign guard's recess 20. Preferably, the depth 24 is equal to or greater than the thickness 26 of the sign 14 so that the sharp edges 12 of the sign 14 are recessed into the sign guard 10 and prevent lacerations and injury to pedestrians and pets even though the pedestrians and pets may graze the front of the sign 14 and sign guard 10.

The recess 20 may also be defined by a lower surface 28 which contacts the backside of the sign 14. The lower surface 28 regulates the insertion distance of the sign 14 into the recess 20. The lower surface 28 may also have a thickness 34. The thickness 34 may be equidistant about the entire perimeter of the sign guard 10. However, it is also contemplated that the lower surface 28 may be a plurality of tabs that extend inward and regulate the insertion distance of the sign 14 into the recess 20. The thickness 34 may be ⅛ inch or more.

A through hole 36 is formed in the lower surface 28. The through hole 36 may be formed for the purposes of lightening the sign guard 10 as well as relieving stress to mitigate warpage during certain manufacturing techniques, as discussed below. The lower surface 28 may also form at least one mounting pad 38. In the drawings, two mounting pads 38 are shown. These mounting pads 38 are disposed on opposed sides of the through hole 36. The mounting pads 38 may extend inwardly as shown in FIG. 2. However, it is also contemplated that the mounting pads 38 may be formed directly on the lower surface 28 immediately adjacent to the side surface 22. The formation and position of the mounting pads 38 depend on how the sign 14 is mounted to the post 40.

The mounting pads 38 are shown as being disposed one above the other in FIG. 2. However, the mounting pad 30 may be positioned anywhere about the inner periphery of the through hole 36. By way of example and not limitation, the mounting pads 38 may be positioned horizontally across from each other instead of vertically as shown. Moreover, the mounting pads 38 may have a through hole 42 for receiving screws 44 to mount the sign 14 and sign guard 10 to the post 48. These through holes 42 may be aligned to the through holes 43 of the sign 14 used to mount the sign 14 to the post 48. These through holes 42 formed in the mounting pads 38 of the sign guard 10 may be formed in the following manner. Initially, the mounting pads 38 are provided without through holes 42. The installer may lay the sign 14 into the recess 20 of the sign guard 10. The installer may mark the location of the through holes 42 and drill the through holes 42 for the purposes of mounting. Alternatively, the sign guard 10 may have predrilled holes 42 fitted to a particular sign 14. These predrilled holes 44 may be aligned somewhere on the mounting pads 38.

The sign guard 10 may be manufactured from a variety of materials including but not limited to a multilayer polyethylene material or an injection molding material. To manufacture the sign guard 10 from a multilayer polyethylene material, a sheet of the multi-layer polyethylene material is provided. The multilayer polyethylene sheet may be cut to size by one of the plurality of different manufacturing methods including but not limited to milling and CNC (computer numerical controlled) machining. As the multilayer polyethylene sheet is being cut by the machine, the stresses between the layers of polyethylene are being redistributed and may cause the multilayer polyethylene sheet to warp. By providing the through hole 36, this redistributes the stress so that the border 30 and the lower surface 28 remain flat so that the lower surface can receive the sign 14. The CNC machine may cut the outer perimeter 16 to size then cut the recess 20 including but not limited to the side surface 22 and the lower surface 28 as well as the inner perimeter 50 of the through hole 36.

It is also contemplated that the sign guard may be manufactured by injection molding techniques. In particular, a mold having a negative cavity for forming the sign guard 10 shown in FIG. 2 is provided. The mold is mounted to an injection molding machine. Injectable material is flowed into the injection molding machine and allowed to take the shape of the negative cavity of the mold.

Figure 3:
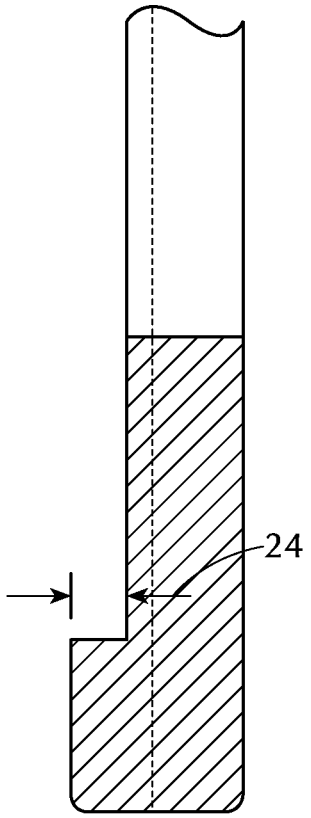
FIG. 3 is a cross-sectional view of the sign guard shown in FIG. 2.
Figure 4:
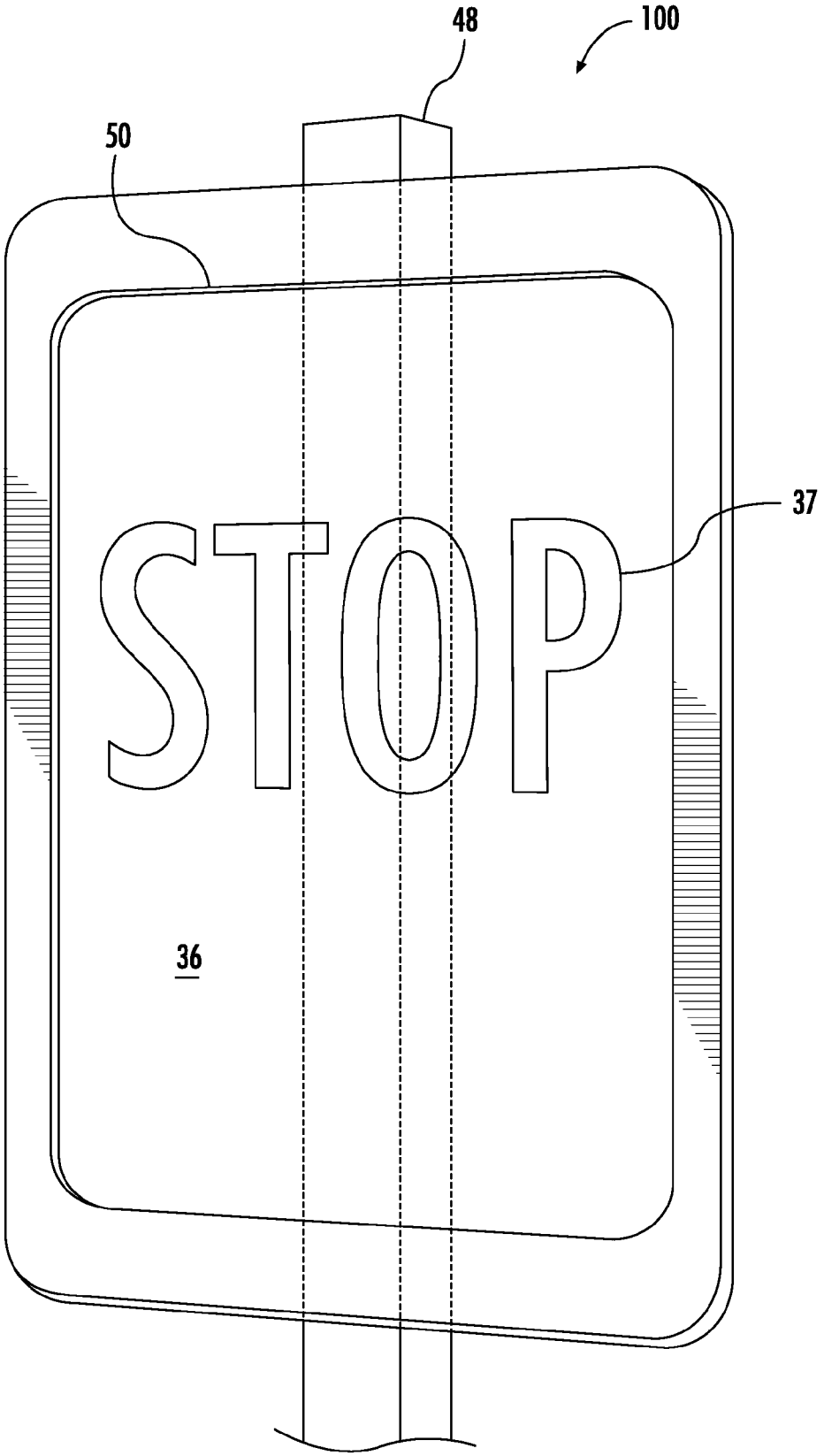
FIG. 4 is a front view of another embodiment of the sign guard.

Referring now to FIG. 4, a second embodiment of the sign guard 100 is shown. The sign guard 100 is substantially similar to the sign guard 10 discussed above in relation to FIGS. 2-3. However, the sign guard 100 does not have mounting pads 38 and is additionally mounted to the post 48 so that no through hole is formed in the front of the sign 14. A hole does not need to be formed in the print area of the sign 14. Moreover, the visible indicia 37 of the sign 14 is viewed through the through hole 36.

More particularly, as described above, the mounting pads 38 extend inwardly into the through hole 36. In the embodiment shown in FIG. 4, the inner perimeter 50 of the through hole 36 is straight where the mounting pads 38 were located on the sign guard 10.

Figure 5:
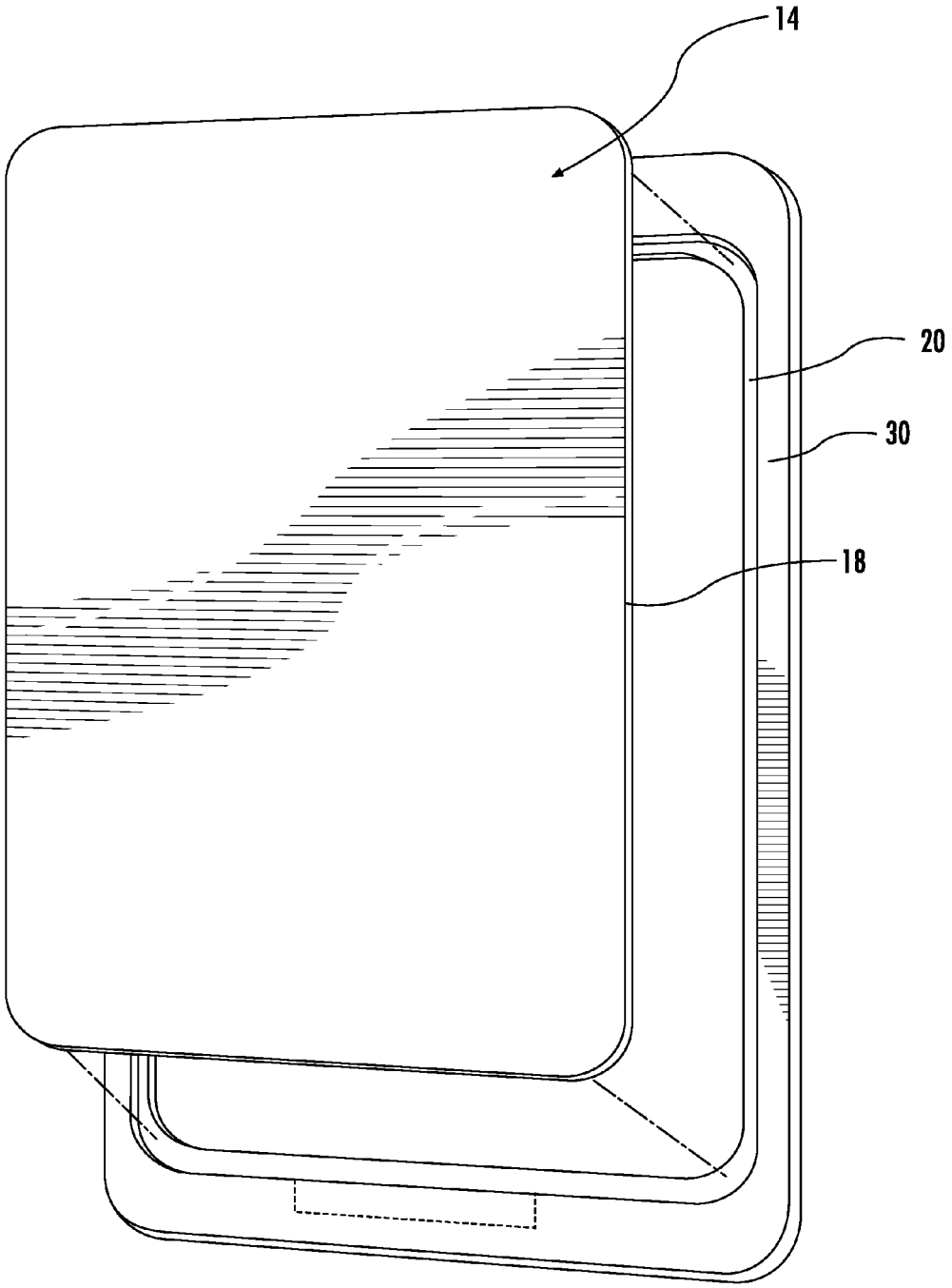
FIG. 5 is a rear view of the sign guard shown in FIG. 4 with a sign being disposed within a recess of the sign guard.
Figure 6:
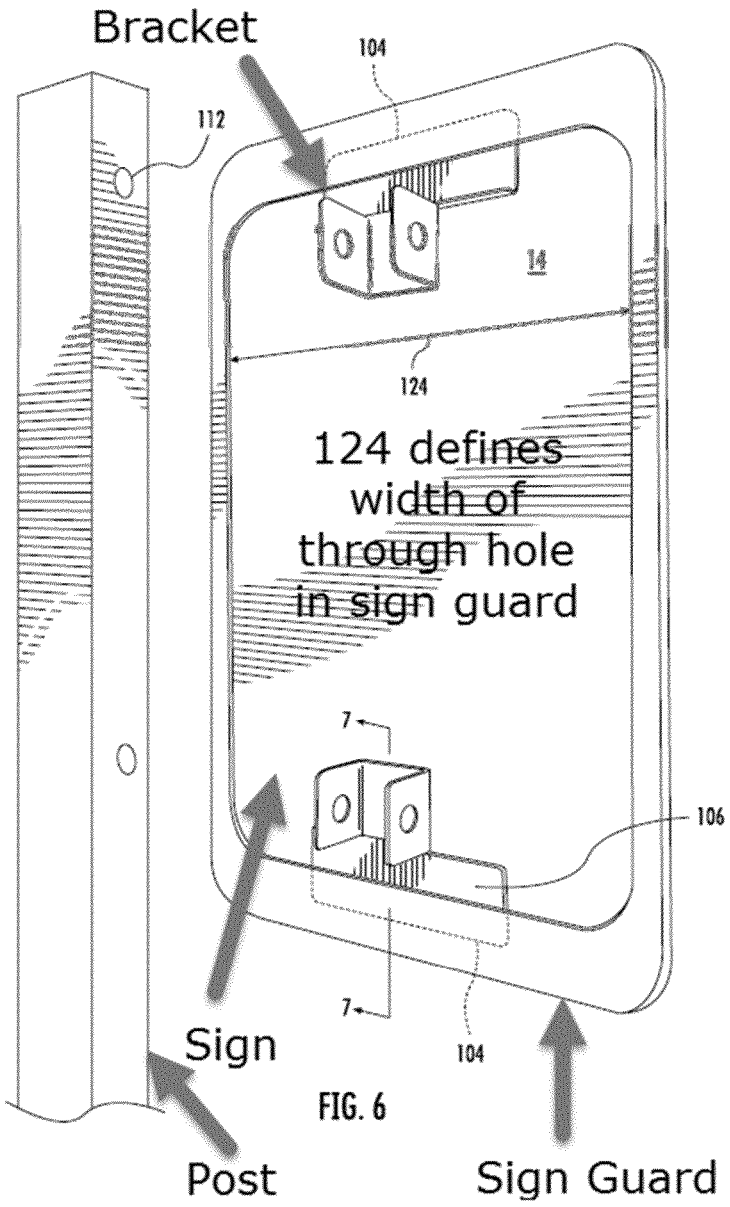
FIG. 6 is a rear perspective view of the sign guard and retaining clips for retaining the sign in the recess and mounting the sign to a post.
Figure 7:
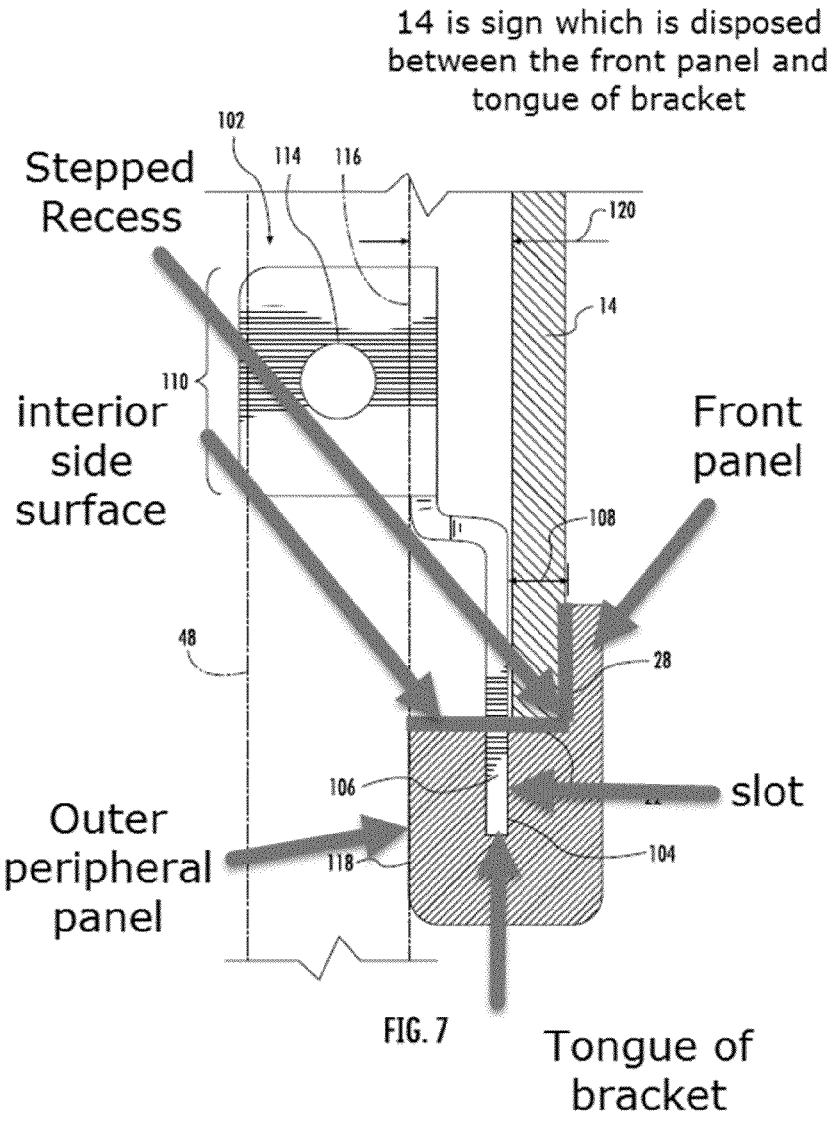
FIG. 7 is a cross sectional view of the sign, sign guard and retaining clip shown in FIG. 6.

Referring now to FIG. 5, the sign 14 may be disposed within the recess 20 with the visible indicia showing through the through hole 36. The outer perimeter 18 of the sign 14 is covered by the border 30 of the sign guard 10 to protect people and animals from the sharp edges of the sign 14. To retain the sign 14 in the recess 20, the sign 14 is locked between a retaining clip 102 and the lower surface 28 of the sign guard 100 on one or more sides of the sign 14. The retaining clip 102 may also be referred to as a mounting bracket or bracket. In FIG. 6, the retaining clips 102 are disposed on opposed sides of the sign 14.

The side surface 22 of the recess 20 may have a slot 104. A pair of slots 104 may be formed on opposed side surfaces 22 of the recess 20 as shown ill FIG. 6. The slot 104 is sized and configured to receive a tab 106 of the retaining clip 102. The tab 106 may also be referred to as a tongue. Preferably, the tab 106 snugly fits within this slot 104. Moreover, the gap 108 defined by the tab 106 and the lower surface 28 is sized and configured to provide a snug fit for the sign 14 and the recess 20. in this manner as the sign 14 moves due to wind and rain, the assembly does not rattle or make undesirable noises. Once the retaining clips 102 are disposed within the slots 104 and the sign 14 is disposed in the sign guard 100, the sign 14 cannot be dislodged from the sign guard 100. The retaining clips 102 may have a U- channel 110 that is secured to the post 48 by way of a nut and bolt connection. The post 48 may have transverse holes 112 that are alignable to the holes 114 in the U-channel 110, No holes are formed in the sign 14. By mounting both retaining clips 102 to the post 48, the retaining clips 102 cannot he dislodged from the slot 104. The sign 14 is permanently secured to the sign guard 100 and the retaining clip 102. in this manner, the sign 14 is permanently secured to the post 48 and also the sign guard 100 provides protection from the sharp edges of the sign 14.

The side surface 22 of the recess 20 may have a slot 104. A pair of slots 104 may be formed on opposed side surfaces 22 of the recess 20 as shown in FIG. 6. The slot 104 is sized and configured to receive a tab 106 of the retaining clip 102. Preferably, the tab 106 snugly fits within this slot 104. Moreover, the gap 108 defined by the tab 106 and the lower surface 28 is sized and configured to provide a snug fit for the sign 14 and the recess 20. In this manner as the sign 14 moves due to wind and rain, the assembly does not rattle or make undesirable noises. Once the retaining clips 102 are disposed within the slots 104 and the sign 14 is disposed in the sign guard 100, the sign 14 cannot be dislodged from the sign guard 100. The retaining clips 102 may have a U-channel 110 that is secured to the post 48 by way of a nut and bolt connection. The post 48 may have transverse holes 112 that are alignable to the holes 114 in the U-channel 110. No holes are formed in the sign 14. By mounting both retaining clips 102 to the post 48, the retaining clips 102 cannot be dislodged from the slot 104. The sign 14 is permanently secured to the sign guard 100 and the retaining clip 102. In this manner, the sign 14 is permanently secured to the post 48 and also the sign guard 100 provides protection from the sharp edges of the sign 14.

The sign 14 cannot be removed from the sign guard 100 or unmounted from the post 48 except by detaching the U-channel 110 of the retaining clips 102 from the post 48. The U-channel 110 may have a support surface 116 that resides within the same plane as an upper surface 118 of the border 30. This allows the post 48 to rest against the support surface 116 and the upper surface 118 when the sign guard 100 and sign 14 are mounted to the post 48. Since the post 48 extends across the sign guard 100, the sign 14 cannot be bent and pushed out of the sign guard 100 due to vandalism. The post 48 is blocking movement of the sign 14 by distance 120. The sign 14 may bend slightly but will be stopped by the sign post 48 from being pushed out.

Figure 8:
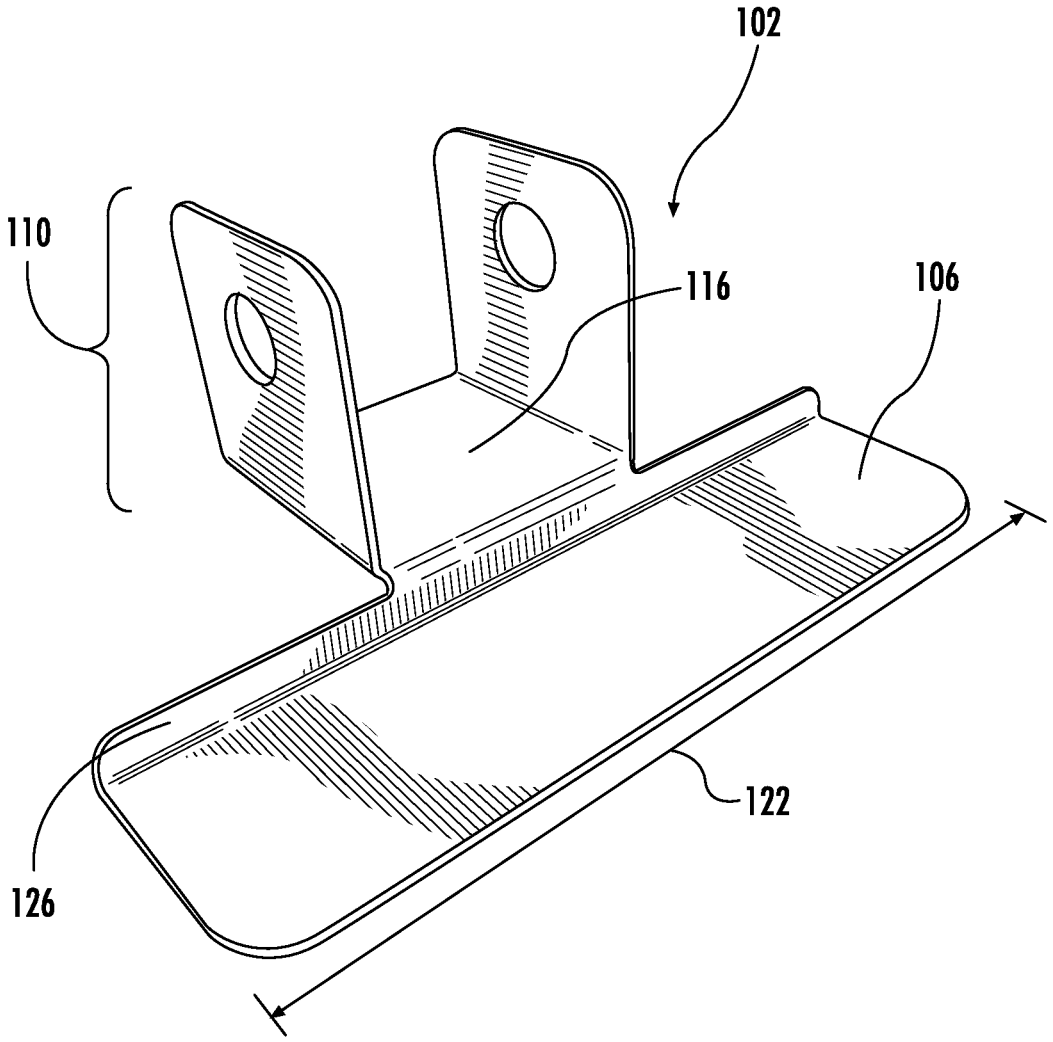
FIG. 8 is a perspective view of the retaining clip.

Referring now to FIG. 8, the retaining clip 102 is shown. The tab 106 may have a width 122 that is about one half or more of a width 124 of the recess 20 and provides additional support to the sign 14 and prevent vandals from removing the sign 14 from the sign guard 100. The wide tab 106 mitigates bending of the sign guard 100 and the sign 14 when trees and other objects brush against the side of the sign 14. The wide tab 106 may reinforce the sign guard 100 if fabricated from a material that is stiffer and stronger than the material of the sign guard. By way of example and not limitation, if the sign guard 100 is fabricated from plastic whereas the tab 106 is fabricated from steel. Although the width 122 of the tab 106 is shown as being about one half or more of the width 124 the recess 20, it is also contemplated that the tab 106 may be less than one half of the width 124 of the recess 20.

The support surface 116 of the U-channel 110 may be raised above the tab 106 by way of offset ledge 126 so that the support surface 116 of the U-channel 110 is in the same plane as the upper surface 118 of border 30 of the sign guard 100. This makes the sign 14 and sign guard 100 assembly more stable. The retaining clip 102 may be formed from a stamping process. Initially, a flat plate is stamped out of a larger sheet, Thereafter, the flat plate is bent and cut until the final form is reached as shown in FIG. 8. The U-channels 110 are used to mount the retaining clips 102 to the post 48. However, other means and methods are also contemplated that are known in the art or developed in the future. By way of example and not limitation, the U-channel 110 may be fitted or replaced with a strap that is tightened about the post 48. Additionally, custom mechanisms for attaching the retaining clip 102 to the post 48 may be employed to attach the portion of the retaining clip 102 replacing the U-channel 110 to the post 48. The mechanisms for attaching the sign guard 100 to a post may be sized and configured to receive other shapes of posts 48 such as round, rectangular, triangular, pentagonal, etc. By way of example, the U-channel 110 may be replaced with a flexible metallic strapping mechanism that can be tightened around a round post, rectangular post or square post instead the sign guard being bolted to the post as shown in the drawings. Moreover, regardless of the attachment device (e.g., U-channel or flexible metallic strapping mechanism) for attaching the retaining clip 102 to the post 48, the upper surface 118 of the border 30 preferably contacts the post 48 but doing so is not necessary.

The retaining clips 102 may be fabricated from a metallic material. By way of example and not limitation, the retaining clips 102 may be fabricated from stainless steel, aluminum, or other metallic material known in the art or developed in the future. Other types of material other than metallic are also contemplated to fabricate the retaining clips 102.

The above description is given by way of example, and not limitation. Given the above disclosure, one skilled in the art could devise variations that are within the scope and spirit of the invention disclosed herein, including various ways of configuring the overall shape. Further, the various features of the embodiments disclosed herein can be used alone, or in varying combinations with each other and are not intended to be limited to the specific combination described herein. Thus, the scope of the claims is not to be limited by the illustrated embodiments.

The invention claimed is:

1. A method of mounting a sign to a post, the method comprising the steps of:

inserting a sign into a stepped recess of a sign guard, the stepped recess defined by a front panel of the sign guard and an outer peripheral panel, the outer peripheral panel having an interior side surface;

inserting a tongue of a first bracket into a first slot formed in a first interior side surface of the outer peripheral panel with the sign disposed between the front panel and the tongue of the first bracket;

inserting a tongue of a second bracket into a slot formed in a second interior side surface of the outer peripheral panel opposite the first side of the recess, the sign disposed between the front panel and the tongue of the second bracket;

securing the first and second brackets to the post thereby locking the sign in the sign guard and mounting the sign and sign guard to the post.

2. The method of claim 1 wherein the inserting the sign step includes the step of inserting the sign into the stepped recess of the sign guard with a depth of the stepped recess being greater than a thickness of the sign.

3. The method of claim 1 wherein the method further includes the step of:

forming the first and second brackets with an offset between the first and second tongues to attachment devices so that a rear side of the sign guard is flush to the post when the first and second brackets are secured to the post.

4. The method of claim 1 wherein the securing the first and second brackets step includes the step bolting attachment devices to the post.

5. The method of claim 1 wherein the securing the first and second brackets step includes the step of strapping the attachment devices to the post.

6. The method of claim 1 further comprising the steps of forming the first and second slots greater than ½ of a width of the first and second sides.

7. The method of claim 1 wherein the first and second sides are upper and lower sides.

8. A mounting system for a sign, the system comprising:

a sign having a thickness and defining an outer peripheral edge and an outer peripheral portion, the sign having an indicia on an exposed side of the sign;

a sheet having a thickness greater than the thickness of the sign, the sheet having a through hole for exposing the indicia on the exposed side of the sign through the through hole, the sheet being larger than the sign, the sheet having a stepped recess for receiving the sign so that an outer peripheral panel of the sheet covers the outer peripheral edge of the sign and a front panel of the sheet covers an outer peripheral portion of the sign when the sign is received into the stepped recess, a first interior side surface of the stepped recess having a first slot, a second interior side surface of the stepped recess having a second slot;

a first mounting bracket having a first tongue and a first attachment device, the first tongue being receivable into the first slot with the sign disposed between the front panel and the first tongue, the first attachment device being offset from the first tongue;

a second mounting bracket having a second tongue and a second attachment device, the second tongue being receivable into the second slot with the sign disposed between the front panel and the second tongue, the second attachment device being offset from the second tongue.

9. The system of claim 8 wherein the sheet in injection molded.

10. The system of claim 8 wherein the first and second attachment devices are square U shaped channels.

* * * * *